US008365543B2

(12) United States Patent
Kondou et al.

(10) Patent No.: US 8,365,543 B2
(45) Date of Patent: Feb. 5, 2013

(54) COOLING STORAGE

(75) Inventors: Naoshi Kondou, Toyoake (JP); Akihiko Hirano, Toyoake (JP); Masahide Yatori, Toyoake (JP); Shinichi Kaga, Toyoake (JP); Hideyuki Tashiro, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 755 days.

(21) Appl. No.: 12/529,407

(22) PCT Filed: Mar. 12, 2007

(86) PCT No.: PCT/JP2007/054790

§ 371 (c)(1),
(2), (4) Date: Sep. 1, 2009

(87) PCT Pub. No.: WO2008/111149

PCT Pub. Date: Sep. 18, 2008

(65) Prior Publication Data

US 2010/0089094 A1 Apr. 15, 2010

(51) Int. Cl.
*F25B 5/00* (2006.01)

(52) U.S. Cl. ..... 62/199; 62/200; 62/504

(58) Field of Classification Search ..... 62/199, 62/200, 504

See application file for complete search history.

(56) References Cited

U.S. PATENT DOCUMENTS

| | | | | |
|---|---|---|---|---|
| 6,185,948 | B1 * | 2/2001 | Niki et al. | 62/199 |
| 6,370,895 | B1 * | 4/2002 | Sakuma et al. | 62/199 |
| 6,598,410 | B2 * | 7/2003 | Temmyo et al. | 62/179 |
| 8,104,301 | B2 * | 1/2012 | Kang | 62/200 |
| 8,161,763 | B2 * | 4/2012 | Yun et al. | 62/200 |

FOREIGN PATENT DOCUMENTS

| | | |
|---|---|---|
| JP | 08-212448 | 8/1996 |
| JP | 2000-230767 | 8/2000 |
| JP | 2000-329443 | 11/2000 |
| JP | 2002-071233 | 3/2002 |
| JP | 2002-071245 | 3/2002 |
| JP | 2002-071255 | 3/2002 |
| JP | 2002-333254 | 11/2002 |
| JP | 2003-028553 | 1/2003 |
| JP | 2003-065619 | 3/2003 |
| JP | 2003-214748 | 7/2003 |
| JP | 2006-125843 | 5/2006 |

OTHER PUBLICATIONS

International Search Report dated Apr. 24, 2007 for International Application No. PCT/JP2007/054790.

* cited by examiner

*Primary Examiner* — Marc Norman
(74) *Attorney, Agent, or Firm* — Wenderoth, Lind & Ponack, L.L.P.

(57) ABSTRACT

A liquid refrigerant from a compressor and a condenser is alternately supplied to a cooling device for the freezing room 27F and an evaporator for refrigeration room through a three-way valve, so as to conduct the cooling of a freezing room and a refrigeration room. When the thermal load condition of a refrigerating cycle is light, the three-way valve switches to the "F side opened-state" after the compressor is stopped, and thereby conducting pressure balancing, without the liquid refrigerant flowing into the evaporator for refrigeration room. A cooling storage, wherein from one compressor a refrigerant is selectively supplied to multiple evaporators, is constituted so as to prevent one evaporator side from becoming a super-cooled state, and furthermore, quickly conduct pressure balancing after stop of the compressor.

3 Claims, 7 Drawing Sheets

COOLING STORAGE

BACKGROUND OF THE INVENTION

I. Technical Field

The present invention relates to a cooling storage, which comprises multiple evaporators and supplies a refrigerant to these evaporators from one compressor.

II. Description of the Related Art

As one of this kind of cooling storages, for example, Japanese Unexamined Patent Publication No. 2002-71245 has been disclosed, in which heat insulating freezing room and refrigeration room are partitioned in a heat insulation storage body, while an evaporator is provided in each room, so that a refrigerant is alternately supplied to each of these evaporators from one compressor to produce cooling action.

In this kind of refrigerating cycle of a refrigerator, a refrigerant is compressed by the compressor and then liquefied by the condenser, so as to be alternately supplied to the evaporator for freezing room and the evaporator for refrigeration room that are connected to the exit side of a three-way valve respectively via a capillary tube. The operation of the compressor is stopped on condition that both freezing room and refrigeration room are cooled down to the lower limit set temperature, and when any one of them then exceed the upper limit set temperature, the compressor is restarted.

A commercial refrigerator, which is used in conditions where its door is frequently opened and closed and the ambient temperature is high, is needed to be designed considering possibility of a rapid rise of the temperature within the rooms during stoppage of the compressor. Therefore, in this kind of refrigerator, when the operation of the compressor is stopped, the high/low pressure difference between the sucking side and the discharging side of the compressor needs to be eliminated as soon as possible (restarting the compressor with the a large pressure difference causes an overload of the compressor). For this purpose, the three-way valve is operated so that both the entrance sides of the evaporators for the freezing room and the refrigeration room and the condenser side are interconnected with each other, and thus, the refrigerant remained in one evaporator is poured into the other one, eventually, the high/low pressure difference is eliminated quickly.

However, according to the above-mentioned method of interconnecting both evaporators for eliminating the high/low pressure difference right after stopping of the compressor, it has been a problem that the refrigeration room side may be in a supercooled state in a situation where the ambient temperature is low like, for example, in the winter season. The causes are as follows.

For example, in a situation where the preset temperature of the refrigeration room is 3 degrees while that of the freezing room is −20 degrees, and when the ambient temperature reaches a low temperature around 5 degrees, it is hardly necessary to cool the refrigeration room due to the extremely small temperature difference between the inside and the outside of the refrigeration room. This means that the compressor repeats the operation and stops the operation so as to cool only the freezing room. In other words, when the inside of the freezing room exceeds the preset temperature, the compressor is started to supply a refrigerant to the evaporator for freezing room. In response to this, when the inside of the freezing room is cooled to the preset temperature or lower, the compressor is stopped, and at the same time, both the evaporators are interconnected by the three-way valve, so as to eliminate the high/low pressure difference of the compressor. After that, when the inside of the freezing room reaches the preset temperature or above, the compressor is restarted, and thus, the cycle for supplying a refrigerant again to the evaporator for freezing room is repeated by switching the three-way valve.

During this cooling operation, while the compressor is in operation, the three-way valve cannot be switched to supply the refrigerant to the evaporator for refrigeration room. However, after stopping the compressor, the three-way valve is switched to the interconnected state of both evaporators due to the pressure balance, causing the liquid refrigerant being supplied to the evaporator for freezing room to be supplied to the evaporator for refrigeration room through the three-way valve. The liquid refrigerant therefore produces cooling action when gradually evaporating due to the eliminating of the pressure balance. Moreover, when the inside of the freezing room exceeds the preset temperature, the liquid refrigerant also produces cooling action by evaporating at the time of restart of the compressor. As mentioned, according to the conventional refrigerator-freezer, the refrigeration room may be supercooled even without supply of a refrigerant to the evaporator for refrigeration room during the operation of the compressor.

The present invention has been completed based on the above circumstances, and its purpose is to provide a cooling storage, in which from one compressor a refrigerant is selectively supplied to multiple evaporators, preventing one evaporator side from becoming a supercooled state.

SUMMARY OF THE INVENTION

The cooling storage according to the present invention employs the following configuration:

a refrigerating cycle comprising the following A1 to A7;

(A1) a compressor for compressing a refrigerant (A2) a condenser for releasing heat from the refrigerant compressed by the compressor (A3) a valve device, with its entrance connected with the condenser side while its two exits connected with a first and a second refrigerant supply channels, and capable of a selectively interconnecting motion for selectively interconnecting the entrance side with any one of the first and the second refrigerant supply channels, and a commonly interconnecting motion for commonly interconnecting the entrance side with both the first and the second refrigerant supply channels (A4) a first and a second evaporators provided respectively in the first and the second refrigerant supply channels (A5) a throttle device for throttling the refrigerant flowing into each evaporator (A6) a refrigerant exit merging channel, having a check valve therein and commonly connecting the refrigerant exit sides of the first and the second evaporators (A7) a refrigerant circulating channel branched off from the downstream side of the check valve in this refrigerant exit merging channel and connected to the refrigerant sucking side of the compressor;

a storage body wherein the inside thereof is cooled by cold air produced by the first and the second evaporators;

a thermal load detection device for detecting a thermal load condition of the refrigerating cycle; and a valve drive circuit for drive-controlling the valve device; wherein the valve drive circuit allows the valve device to conduct the selectively interconnecting motion during the operation of the refrigerating cycle so as to alternately supply a refrigerant to any one of the first and second evaporators, while on the other hand, during stop of the refrigerating cycle, when the thermal load detection device is detecting a thermal load that exceeds a prescribed value, the valve drive circuit allows the valve device to conduct the commonly interconnecting motion, whereas, when the thermal load detection device is detecting a thermal load that is equal to or lower than a prescribed value, allowing the valve device to conduct the selectively interconnecting motion.

According to the above configuration, the valve device conducts the selectively interconnecting motion during the operation of the compressor, so that a liquid refrigerant is selectively supplied to the first and the second evaporators, and the inside of the storage body is therefore cooled by cooling action of these evaporators. After stop of the compressor, the valve device moves as follows so as to eliminate the high/low pressure difference of the compressor. In other words, when the thermal load condition of the refrigerating cycle is high, the valve device conducts the commonly interconnecting motion for interconnecting the first and the second refrigerant supply channels after stop of the compressor. Since the thermal load condition of the refrigerating cycle is high, the pressure balance between the two evaporators are therefore equilibrated even if the high/low pressure difference of the compressor right after stop thereof is large, and thereby quickly eliminating the high/low pressure difference.

Additionally, in a situation like, for example, in winter season, where the ambient temperature is low, the thermal load condition of the refrigerating cycle is small, and the valve device therefore conducts the selectively interconnecting motion after the compressor is stop, so as to bring only one refrigerant supply channel into an interconnected state. Consequently, the balancing of the high/low pressure difference is progressed. Here, it is concerned that the pressure balancing might become time-consuming since only one evaporator side is used. However, when the thermal load condition of the refrigerating cycle is small, the high/low pressure difference of the compressor right after stop thereof is also small. Thus, there is no problem since the pressure balancing can be conducted in a relatively short period of time. In addition, the thermal load detection device may comprise a temperature sensor provided in the refrigerant discharging side of the condenser, and be constituted so as to detect a thermal load of the refrigerating cycle based on a refrigerant temperature in the refrigerant discharging side. Or, the thermal load detection device may comprise an ambient temperature sensor for detecting ambient temperature of the cooling storage, so as to detect a thermal load of the refrigerating cycle based on the ambient temperature.

Any of the above configurations are advantageous, for being capable of easily detecting the thermal load condition of the refrigerating cycle by using a temperature sensor.

The present invention can provide a cooling storage, in which from one compressor a refrigerant is selectively supplied to multiple evaporators, preventing one evaporator side from becoming a supercooled state, and furthermore, quickly conducting pressure balancing after stop of the compressor.

DETAILED DESCRIPTION OF THE INVENTION

Figure 1:
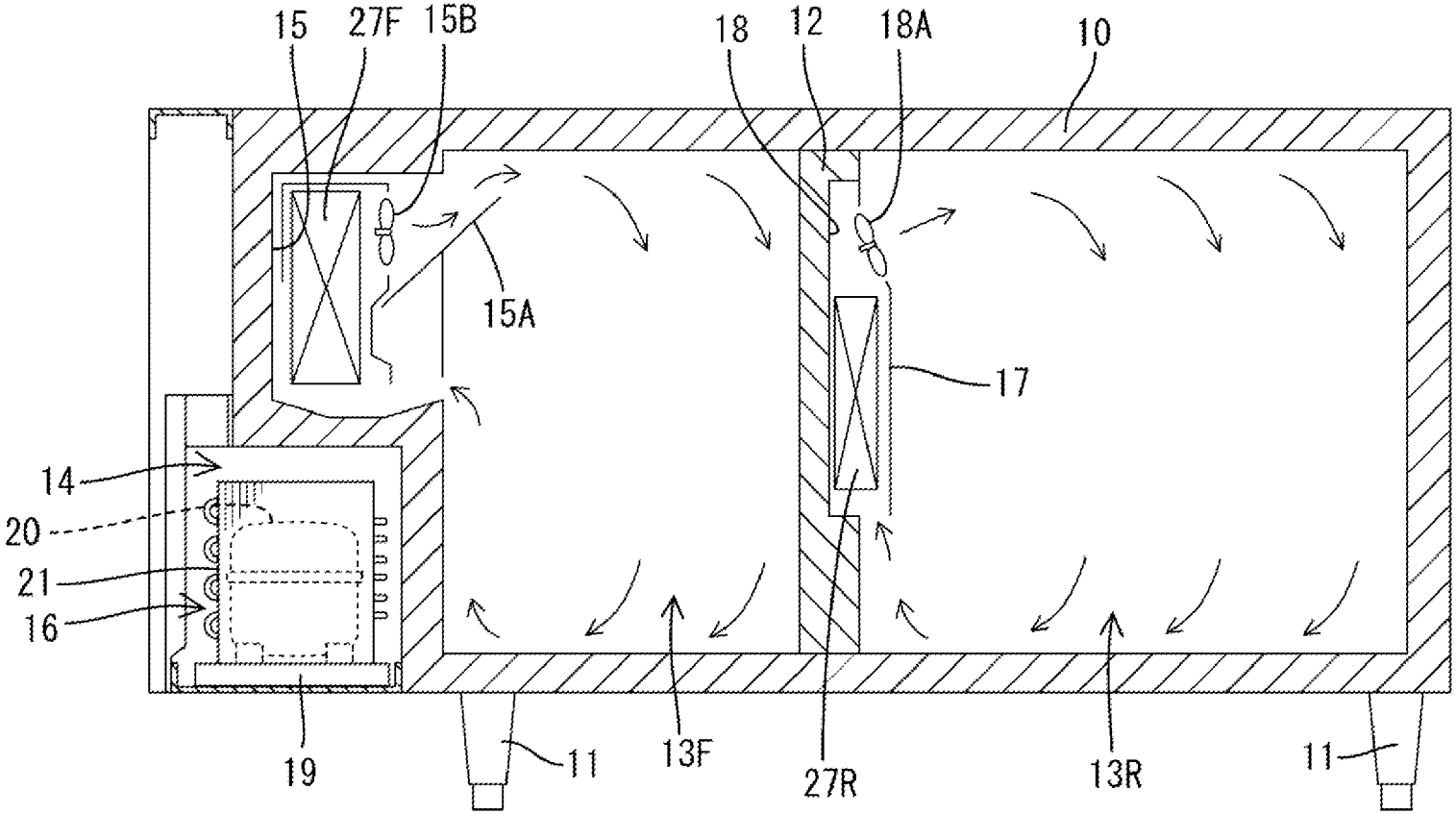
FIG. 1 is an overall cross-sectional view showing one embodiment of the present invention.

As referring now to FIGS. 1 to 6, one embodiment according to the present invention is described. The present embodiment is illustrated by example by being applied to a commercial lateral (table type) refrigerator-freezer, and its entire structure is described as referring firstly to FIG. 1. The symbol 10 represents a storage body, composed of a heat insulating box body, that is horizontally long and opening in the front surface, and supported by legs 11 provided in four corners on the bottom surface. The inside of the storage body 10 is divided into right and left sides by a heat insulating partition wall 12, and the left and relatively narrower side is a freezing room 13F corresponding to a first storage room, while the right and wider side is a refrigeration room 13R corresponding to a second storage room. In addition, although not shown in the drawings, pivotable heat insulating doors are attached to the opening on the front surface of the freezing room 13F and the refrigeration room 13R, so as to be capable of opening and closing.

Provided in the left side when viewed from the front of the storage body 10 is a mechanical room 14. A heat insulating evaporator room 15 for the freezing room 13F which is connected with the freezing room 13F is protrudingly formed in the back of the upper part within the mechanical room 14, and a duct 15A and an evaporator fan 15B are provided therein, while in the lower part thereof, a compressor unit 16 is removably housed. And also, an evaporator room 18 for the refrigeration room 13R is formed on the surface of the partition wall 12 in the side of the refrigeration room 13R by stretching the duct 17, and the evaporator fan 18A is provided therein.

The compressor unit 16 is provided with a compressor 20 for compressing a refrigerant by being driven by a motor not shown and a condenser 21 connected with the refrigerant discharging side of the compressor 20, both disposed on a base 19, so as to be capable of taking in and out of the mechanical room 14. A condenser fan 22 (shown only in FIG. 2) for air-cooling the condenser 21 is also mounted in the compressor unit 16.

Figure 2:
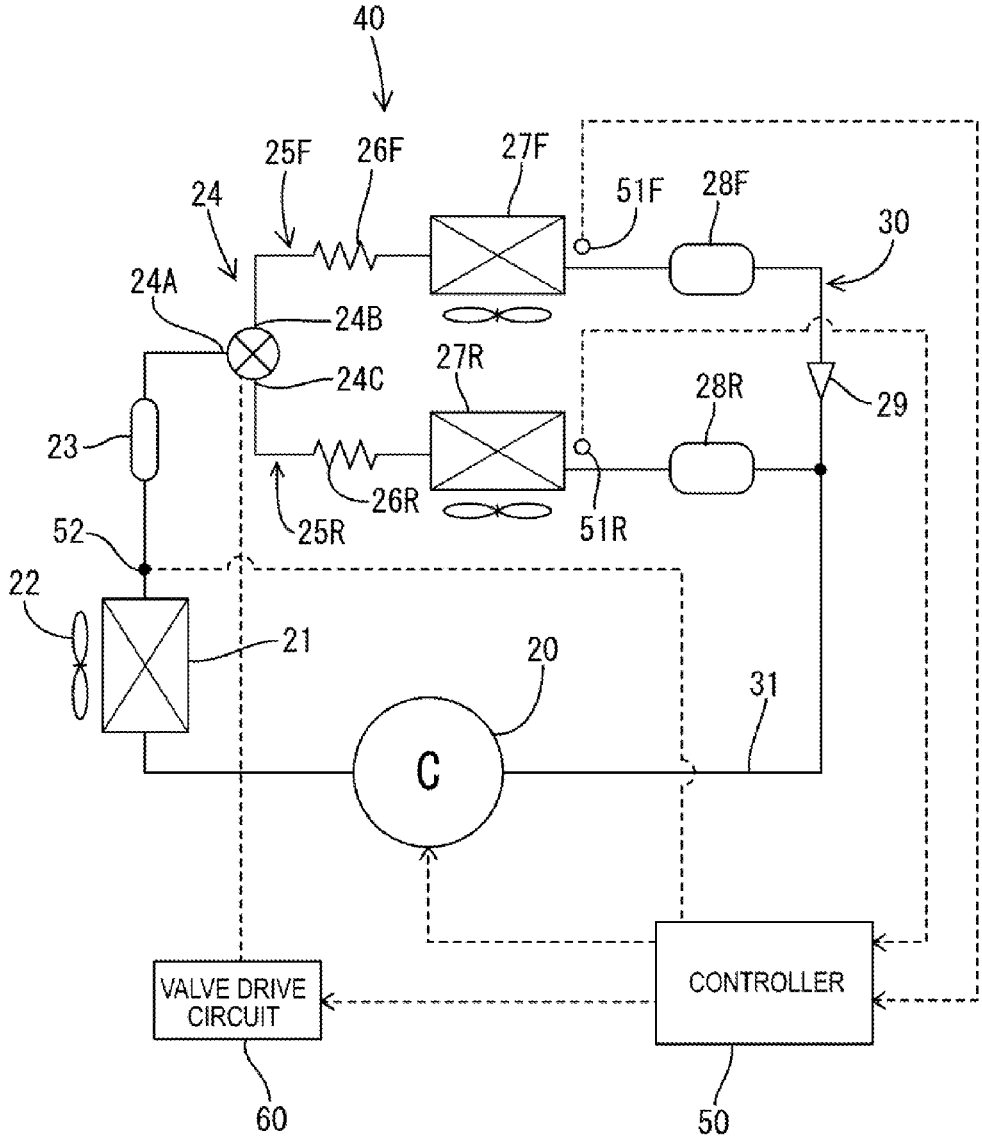
FIG. 2 is a block diagram of a refrigerating cycle.

As shown in FIG. 2, the exit side of the condenser 21 is connected with an entrance 24A of a three-way valve 24 as a valve device via a drier 23. The three-way valve 24 has one entrance 24A and two exits 24B and 24C, and these exits 24B and 24C are respectively continued to a first and a second refrigerant supply channels 25F and 25R. This three-way valve 24 is capable of the selectively interconnecting motion for selectively interconnecting the entrance 24A with any one of the first and the second refrigerant supply channels 25F and 25R, as well as the commonly interconnecting motion for commonly interconnecting the entrance 24A with both the first and the second refrigerant supply channels 25F and 25R.

A capillary tube 26F in the freezing room side corresponding to the throttle device and an evaporator for freezing room 27F (the first evaporator) housed within the evaporator room 15 in the side of the freezing room 13F are provided in the first refrigerant supply channel 25F. And also, a capillary tube 26R in the refrigeration room side corresponding also to the throttle device and an evaporator for refrigeration room 27R (the second evaporator) housed within the evaporator room 18 in the side of the refrigeration room 13R are provided in the second refrigerant supply channel 25R. The refrigerant exits of both the cooling devices 27F and 27R are commonly connected by a refrigerant exit merging channel 30 in which an accumulator 28F, a check valve 29, and an accumulator 28R are sequentially continued, while a refrigerant circulating channel 31 branched off from the downstream side of the check valve 29 in the refrigerant exit merging channel 30 is continued to the sucking side of the compressor 20. The above-mentioned refrigerant circulating channel running from the discharging side back to the sucking side of the compressor 20 composes a known refrigerating cycle 40 for supplying the refrigerant from one compressor 20 to two evaporators 27F and 27R, and is capable of shifting the supplying destination of a liquid refrigerant by the three-way valve 24.

And also, the above-mentioned three-way valve 24 is driven by a valve drive circuit 60 which receives a signal sent from a controller 50. The controller 50 is given a signal from an F sensor 51F that detects the air temperature within the freezing room 13F and an R sensor 51R that detects the air temperature within the refrigeration room 13R, and starts the operation of the compressor 20 when a detected temperature of the F sensor 51F is higher than an ON temperature (TF (ON)) of the freezing room 13F or when a detected temperature of the R sensor 51R is higher than an ON temperature (TR (ON)) of the refrigeration room 13R, and while at the same time, the controller 50 controls the three-way valve 24 by the valve drive circuit 60 in a manner as mentioned later.

And then, a liquid refrigerant temperature sensor (hereinafter, referred to as "CT sensor") 52 is provided in a pipe in the refrigerant discharging side of the condenser 21 for detecting the temperature of the liquid refrigerant being discharged, and gives a detected signal to the controller 50 so that the three-way valve 24 is controlled in a manner as mentioned later. The signal from this CT sensor 52 is used also for detecting and informing an abnormal over-loaded condition of the refrigerating cycle 40 due to failure in heat release caused by the unclean condenser 21 or other reasons.

Figure 3:
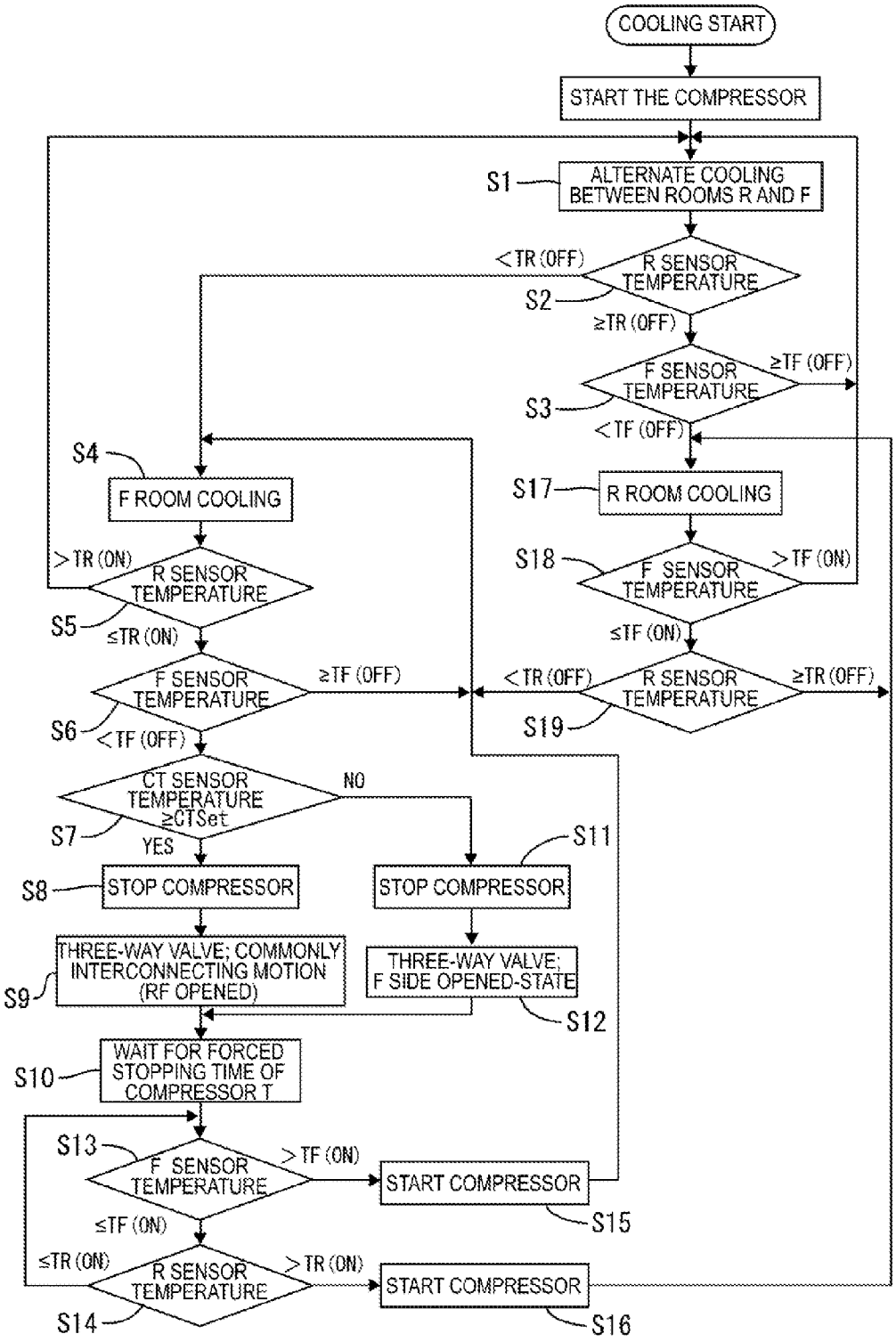
FIG. 3 is a flow chart showing the cooling operation.

The control of the compressor 20 and the three-way valve 24 is executed by CPU not shown built in the controller 50. The constitution of the control program thereof is as shown in FIG. 3, and is described in the following, along with an action of the present embodiment.

(Cooling Start—FR Alternate Cooling)

When the power source to the cooling storage is applied, and the operation of the compressor 20 is started, the three-way valve 24 is alternately switched at constant intervals to a state where the entrance 24A is connected only with the first refrigerant supply channel 25F (hereinafter, this status is referred to as "F side opened-state") and a state where the entrance 24A is connected only with the second refrigerant supply channel 25R side (hereinafter, this status is referred to as "R side opened-state") (step S1), so as to alternately cool the refrigeration room 13R and freezing room 13F (alternate cooling between the rooms R and F). Additionally, both the above "F side opened-state" and "R side opened-state" are one aspect of "selectively interconnecting motion" according to the present invention.

Next, in the step S2, the temperature of the refrigeration room 13R is compared with the lower limit temperature of the refrigeration room TR (OFF) that has been previously set, on the basis of a signal sent from the R sensor 51R, and furthermore, in the step S3, the temperature of the freezing room 13F is compared with the lower limit temperature of the freezing room TF (OFF) that has been previously set, on the basis of a signal sent from the F sensor 51F. At the start of the cooling operation, both temperatures within the rooms are not reaching each lower limit temperature, and the process therefore goes from the step S3 back to the step S1, so that the three-way valve 24 repeats the above-mentioned FR alternate cooling operation that alternately repeats the "F side opened-state" and the "R side opened-state".

(Only F Cooling)

When the cooling proceeded and the temperature within the refrigeration room 13R fell below the lower limit temperature of the refrigeration room TR (OFF), the process moves from the step S2 to the step S4, so that the three-way valve 24 switches to the "F side opened-state" and cools only the freezing room 13F. After that, the process moves on to the step S5 and judges whether or not the temperature within the refrigeration room 13R is reaching the upper limit set temperature TR (ON) of the refrigeration room that has been previously set, based on the signal sent from the R sensor 51R.

In general, the refrigeration room 13R is being sufficiently cooled right after the end of the FR alternate cooling, and thus, the process reaches the next step S6 to judge whether or not the temperature within the freezing room 13F is reaching the lower limit temperature of the freezing room TF (OFF) on the basis of the signal sent from the F sensor 51F, and then repeats the steps from S4 to S6 until the temperature reaches the lower limit temperature of the freezing room TF (OFF). As a result, only the freezing room 13F is intensively cooled down.

Additionally, when the temperature of the refrigeration room 13R rises during the cooling operation of the above, the process moves from the step S5 back to the step S1 and resumes the FR alternate cooling. That means, the temperature rise of the refrigeration room 13R can be quickly controlled since the cooling operation of the refrigeration room 13R is also resumed. This "Only F cooling" cools the freezing room 13F sufficiently, and when the temperature within the room reaches the lower limit temperature of the freezing room TF (OFF), the process moves from the step S6 to the step S7.

(Compressor Stop/Pressure Balancing Process)

In the step S7, the temperature of a liquid refrigerant discharged from the condenser 21 is compared with a prescribed reference temperature CTset (the deciding method thereof is described later) on the basis of a signal sent from the CT sensor 52. Since the ambient temperature is low like in winter season, the thermal load condition of the refrigerating cycle 40 is extremely light when the heat leakage from the storage body 10 is small or when the heat release of the condenser 21 is sufficiently ensured, and thus, the liquid refrigerant temperature becomes low. In reverse, in the seasons other than winter, or when the installation site of the refrigerator-freezer is close to a heat source such as a stove, the thermal load condition of the refrigerating cycle 40 is relatively heavy, and the liquid refrigerant temperature therefore tends to become high.

With this structure, in a situation where the thermal load of the refrigerating cycle 40 is from normal to heavy, the process shows "Y" in the step S7, and then after the stop of the compressor 20 (the step S8), the three-way valve 24 in the step S9 conducts "commonly interconnecting motion" for interconnecting the entrance 24A with both the first and the second refrigerant supply channels 25F and 25R ("RF opened" in the step S9), so as to prohibit the compressor 20 to restart during the lapse of the forced stopping time T (the step S10).

Additionally, in a situation where the thermal load of the refrigerating cycle 40 is relatively light, the process goes "N" in the step S7, and then after the stop of the compressor 20 (the step S11), the three-way valve 24 in the step S12 conducts "selectively interconnecting motion" (here, "F side opened-state" with the entrance 24A interconnected only with the first refrigerant supply channel 25F), so as to prohibit the compressor 20 to restart during the lapse of the forced stopping time T that has been previously set (the step S10).

Figure 4:
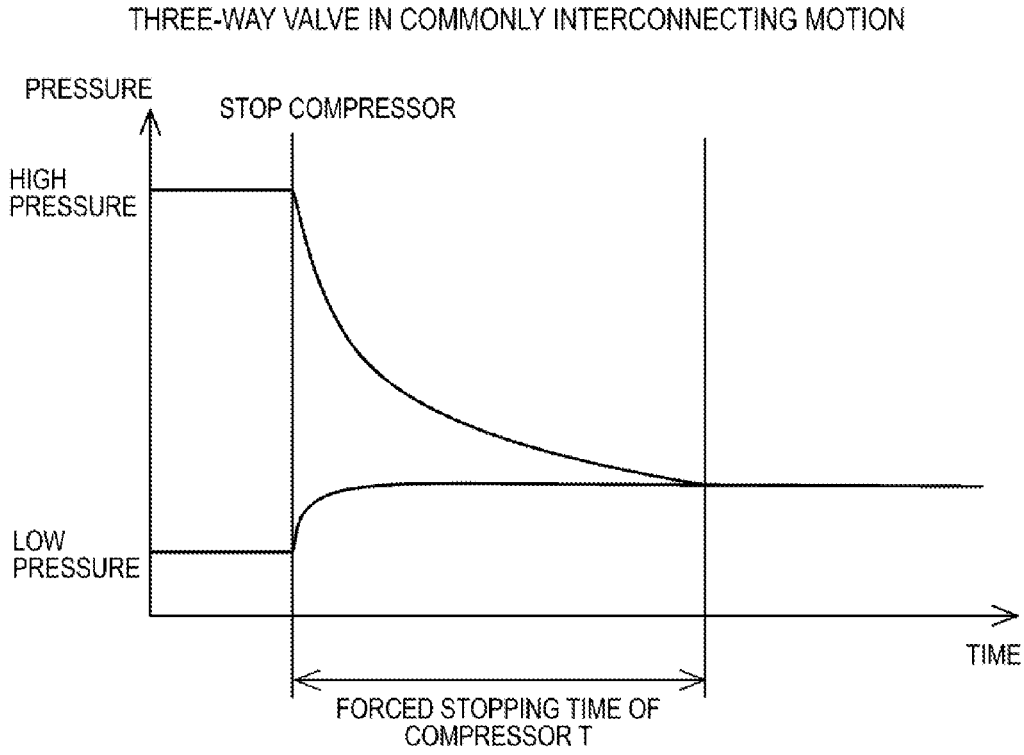
FIG. 4 is a graph showing the pressure change in the compressor stop/pressure balancing process in situation that the thermal load condition of the refrigerating cycle is high.

While this forced stopping time of the compressor T is passing by, the liquid refrigerant is supplied to the cooling device for the freezing room 27F and evaporates, and the high/low pressure difference of the compressor 20 is therefore eliminated. Here, in a situation where the thermal load of the refrigerating cycle 40 is large, the three-way valve 40 conducts "commonly interconnecting motion" for commonly interconnecting both the refrigerant supply channels 25F and 25R that are respectively continuing to both the evaporator for the freezing room 27F and the evaporator for the refrigeration room 27R after the stop of the compressor 20. This causes the pressure balancing motion between two evaporators 27F and 27R due to a large thermal load condition of the refrigerating cycle 40 even in a circumstance where the high/low pressure difference of the compressor right after the stop is large, and thereby the high/low pressure difference is eliminated quickly as shown in FIG. 4.

Figure 5:
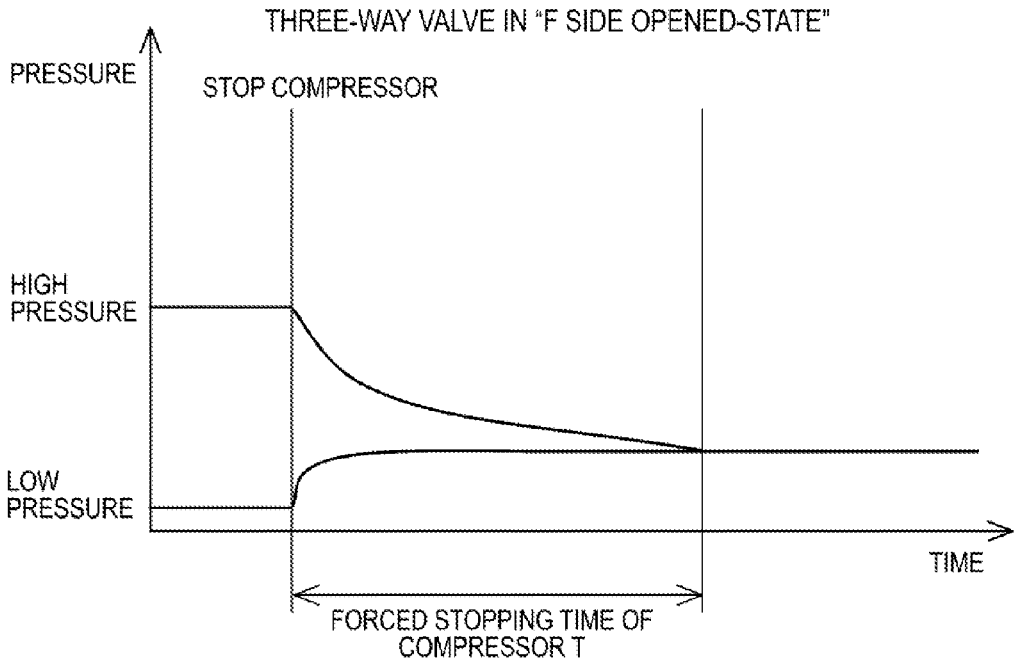
FIG. 5 is a graph showing the pressure change in the compressor stop/pressure balancing process in situation that the thermal load condition of the refrigerating cycle is low.

Additionally, in a situation where the thermal load condition of the refrigerating cycle 40 is small, for example, like in winter season, the three-way valve 24 switches to the "F side opened-state" so as to proceed the balancing of the high/low pressure difference of the compressor 20 only through the refrigerant supply channel 25F continued to the cooling device for the freezing room 27F. However, in this case, the thermal load condition of the refrigerating cycle 40 is small, and the high/low pressure difference of the compressor 20 right after the stop is therefore originally small, as shown in FIG. 5. Consequently, the pressure balancing within the forced stopping time T of the compressor is possible without problems.

(Restart of the Compressor)

When the forced stopping time of the compressor T has passed in the step S10, the process goes on to the step S13, and the temperature within the freezing room 13F is compared with the upper limit set temperature of the freezing room TF (ON) which has been previously set, on the basis of the signal sent from the F sensor 51F. And then, further in the step S14, the temperature within the refrigeration room 13R is compared with the upper limit set temperature of the refrigeration room TR (ON) which has been previously set, on the basis of the signal sent from the R sensor 51R. When the temperature within the freezing room 13F or the refrigeration room 13R is higher than each upper limit set temperature in any one of the above steps, the compressor 20 is started (steps S15 and S16), and the process moves to the step S4 or the step S17, so that the cooling of the freezing room 13F or the refrigeration room 13R is resumed.

Additionally, when the temperature within the freezing room 13F rose after resuming the cooling of the refrigeration room 13R in the step S17, the process goes back to the FR alternate cooling (steps S18 back to S1), and after the sufficient cooling of the refrigeration room 13R, it moves to the "Only F cooling" (the step S19 back to the step S4).

(Example of Time Chart)

Figure 6:
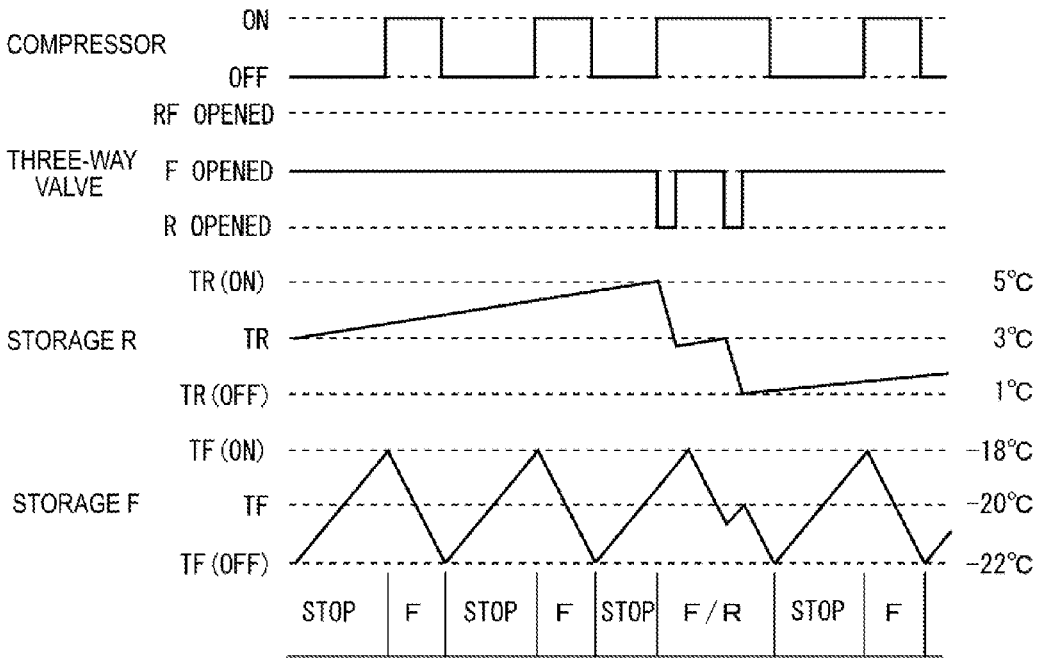
FIG. 6 is a time chart showing the cooling operation and the temperature change for inside of the storage room.

Regarding the cooling operation going from "Only F cooling" back to "Only F cooling" with "FR alternate cooling" therebetween, FIG. 6 shows an example of ON/OFF of the compressor 20 and open/close motion of the three-way valve 24, as well as the temperature change of the freezing room 13F and the refrigeration room 13R. Here, "F" and "F/R" respectively represents that "Only F cooling" and "FR alternate cooling" are in execution, while "Stop" represents that "Compressor stop/pressure balancing process" is in operation.

(Setting Reference Temperature CTset)

As mentioned before, when conducting "Compressor stop/pressure balancing process", which one "F side opened-state" or "commonly interconnecting motion" the three-way valve 24 conducts is decided by comparing a temperature of the liquid refrigerant discharged from the condenser 21 with a reference temperature CTset. This temperature may be actually decided as follows.

To operate the refrigerator-freezer according to the present embodiment in various ambient temperatures, and test whether or not the high/low pressure difference of the compressor 20 falls to an acceptable value within the forced stopping time T of the compressor 20 when "Compressor stop/pressure balancing process" is conducted in "F side opened-state", so as to find the best ambient temperature at which the high/low pressure difference falls to an acceptable value within the forced stopping time T. Then, a temperature of the liquid refrigerant discharged from the condenser 21, which is operating at the said temperature, can be the reference temperature CTset.

Effect of the Present Embodiment

As mentioned above, in the present embodiment, the three-way valve 24 conducts "commonly interconnecting motion" for interconnecting both the evaporators for the freezing room and the refrigeration room after the stop of the compressor 20, when the thermal load condition of the refrigerating cycle 40 is large (when the discharging temperature of the liquid refrigerant from the condenser 21 is high). With this configuration, since the thermal load condition of the refrigerating cycle 20 is large, the balancing motion of the pressure is conducted in two evaporators 27F and 27R even in a circumstance where the high/low pressure difference of the compressor 20 after the stop is large, and thereby quickly eliminating the high/low pressure difference. Additionally, in a situation where the thermal load condition of the refrigerating cycle 40 is small, for example, like in winter season, the three-way valve 24 switches to the "F side opened-state" after the stop of the compressor 20, and the refrigerant does not therefore flow into the evaporator 27R for refrigeration room, never causing the refrigeration room 13R to be in a supercooled state. Accordingly, when the three-way valve 24 is in "F side opened-state", it can be regarded that the evaporator 27R for refrigeration room does not contribute to pressure balancing. However, when the thermal load condition of the refrigerating cycle 40 is small, the high/low pressure difference of the compressor 20 right after the stop thereof is also small. Therefore, the pressure balancing is conducted in a relatively short period of time, so that a circumstance does not occur where the pressure balancing does not end even after the lapse of the forced stopping time T.

When detecting the thermal load condition of the refrigerating cycle 40 in the present embodiment, the liquid refrigerant temperature sensor 52 (CT sensor) provided in the pipe in the refrigerant discharging side of the condenser 21 is used for the detection of the liquid refrigerant temperature. Furthermore, the sensor 52 is also used for detecting and informing an abnormal over-loaded status of the refrigerating cycle 40 due to failure in heat release caused by the unclean condenser 21 or other reasons, and thus the embodiment is extremely rational.

With embodiments of the present invention described above with reference to the accompanying drawings, it is to be understood that the invention is not limited to those precise embodiments, and the embodiment as below, for example, can be within the scope of the present invention.

Figure 7:
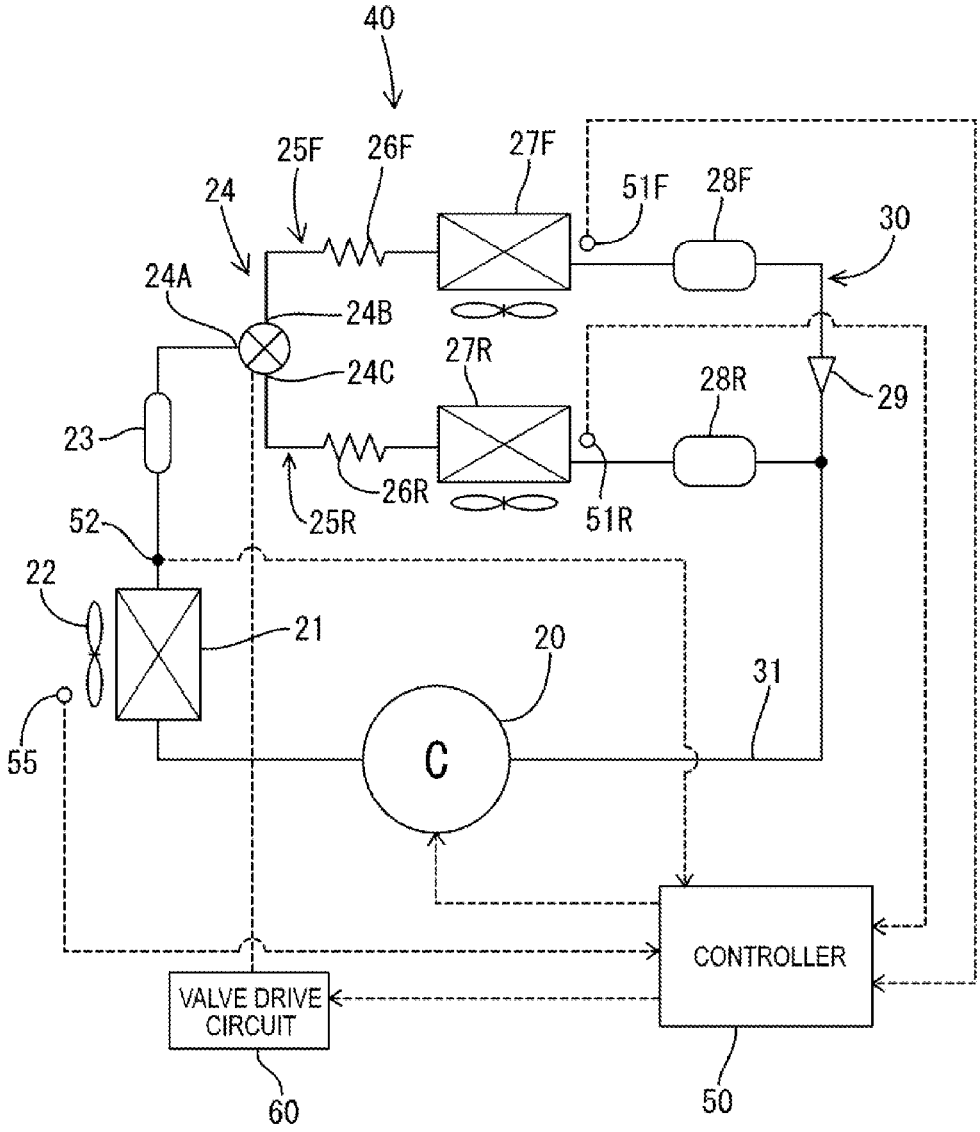
FIG. 7 is a block diagram of the refrigerating cycle showing a different embodiment of the present invention.

(1) In the above embodiment, the CT sensor 52 in the discharging side of the condenser 21 is used for the detection of the liquid refrigerant temperature when detecting the thermal load condition of the refrigerating cycle 40, however, the present invention is not limited to this, and as shown in FIG. 7, an ambient temperature sensor 55 for detecting the ambient temperature of the cooling storage may be provided in the sucking side of the cooling fan 22 in the condenser 21, so as to detect the thermal load of the refrigerating cycle based on a detected ambient temperature. The embodiment shown in FIG. 7 is different from the one in FIG. 2 in regard only to this ambient temperature sensor 55, while the other structures are the same as those in FIG. 2. Thus, the same numerals are allotted for the same items so as to omit repetitive explanations.

(2) Additionally, when detecting the thermal load of the refrigerating cycle, for example, a pressure in the discharging side of the compressor 20 in the refrigerating cycle may be detected, or it may be achieved on the basis of such as a temperature of the condenser 21 (the temperature of cooling wind).

(3) In the above embodiment, a cooling storage comprising a freezing room and a refrigeration room is explained by example, however, the present invention is not limited to this, and may be applied to a cooling storage comprising a refrigeration room and a thawing room, or two refrigeration rooms, or two freezing rooms having different storage temperatures. In short, the present invention may be broadly applied to cooling storages which comprise at least two evaporators and supply a refrigerant from a compressor that is common to these two evaporators.

The invention claimed is:

1. A cooling storage comprises:

a refrigerating cycle comprising a compressor for compressing a refrigerant, a condenser for releasing heat from the refrigerant compressed by the compressor, a valve device having an entrance and two exits, the entrance being connected to the condenser, the exits being connected to a first and a second refrigerant supply channels, respectively, and capable of a selectively interconnecting motion for selectively interconnecting the entrance side with any one of the first and the second refrigerant supply channels, and a commonly interconnecting motion for commonly interconnecting the entrance side with both the first and the second refrigerant supply channels, first and second evaporators provided respectively in the first and the second refrigerant supply channels, a respective throttle device for throttling the refrigerant flowing into each evaporator, a refrigerant exit merging channel which has a check valve and commonly connects the refrigerant exit sides of the first and the second evaporators, and a refrigerant circulating channel branched off from the downstream side of the check valve in the refrigerant exit merging channel and connected to the refrigerant sucking side of the compressor;

a storage body wherein the inside thereof is cooled by cold air produced by the first and the second evaporators;

a thermal load detection device for detecting a thermal load condition of the refrigerating cycle; and a valve drive circuit for drive-controlling the valve device;

wherein the valve drive circuit allows the valve device to conduct the selectively interconnecting motion during the operation of the refrigerating cycle so as to alternately supply a refrigerant to any one of the first and the second evaporators, while on the other hand, during stoppage of the refrigerating cycle, when the thermal load detection device is detecting a thermal load that exceeds a prescribed value, the valve drive circuit allows the valve device to conduct the commonly interconnecting motion, whereas, when the thermal load detection device is detecting a thermal load that is equal to or lower than a prescribed value, allowing the valve device to conduct the selectively interconnecting motion.

2. The cooling storage according to claim 1, wherein the thermal load detection device comprises a temperature sensor provided in the refrigerant discharging side of the condenser, and is configured to detect a thermal load of the refrigerating cycle based on a refrigerant temperature in the refrigerant discharging side.

3. The cooling storage according to claim 1, wherein the thermal load detection device comprises an ambient temperature sensor for detecting an ambient temperature of the cooling storage, and is configured to detect a thermal load of the refrigerating cycle based on the ambient temperature.

* * * * *